US011549348B2

(12) United States Patent
Cicci et al.

(10) Patent No.: US 11,549,348 B2
(45) Date of Patent: Jan. 10, 2023

(54) APPARATUS AND METHODS FOR INTERLOCKING HYDRAULIC FRACTURING EQUIPMENT

(71) Applicant: Universal Pressure Pumping, Inc., Houston, TX (US)

(72) Inventors: Michael Raymond Cicci, Houston, TX (US); Michael Patrick Sowko, Rostraver Township, PA (US)

(73) Assignee: Universal Pressure Pumping, Inc., Houston, TX (US)

( * ) Notice: Subject to any disclaimer, the term of this patent is extended or adjusted under 35 U.S.C. 154(b) by 0 days.

(21) Appl. No.: 17/100,471

(22) Filed: Nov. 20, 2020

(65) Prior Publication Data

US 2021/0156240 A1 May 27, 2021

Related U.S. Application Data

(60) Provisional application No. 62/941,459, filed on Nov. 27, 2019.

(51) Int. Cl.
*E21B 43/26* (2006.01)
*F04B 39/12* (2006.01)

(52) U.S. Cl.
CPC ..... *E21B 43/2607* (2020.05); *E21B 43/26* (2013.01); *F04B 39/123* (2013.01)

(58) Field of Classification Search
CPC .... E21B 43/2607; E21B 43/26; F04B 39/123; F04B 23/04; F04B 53/16; F04B 15/02
See application file for complete search history.

(56) References Cited

U.S. PATENT DOCUMENTS

| | | | | |
|---|---|---|---|---|
| 2010/0032031 | A1* | 2/2010 | Neal | E21B 21/02 137/565.01 |
| 2016/0319650 | A1* | 11/2016 | Oehring | E21B 43/267 |
| 2020/0088021 | A1* | 3/2020 | Guidry | E21B 43/26 |
| 2020/0115983 | A1* | 4/2020 | Nanney | E21B 34/02 |
| 2020/0277845 | A1* | 9/2020 | Kajaria | E21B 43/26 |
| 2021/0010358 | A1* | 1/2021 | Guidry | E21B 43/2607 |

FOREIGN PATENT DOCUMENTS

| | | | | |
|---|---|---|---|---|
| GB | 2439550 A | * | 1/2008 | F16L 55/005 |

* cited by examiner

*Primary Examiner* — James G Sayre
(74) *Attorney, Agent, or Firm* — Dorsey & Whitney LLP

(57) ABSTRACT

A method for interconnecting components of a hydraulic fracturing system using flexible hose or pipe. The flexible hose or pipe can form a singular flow line which interconnects, for example, a pump and a manifold of the hydraulic fracturing system. Each end of the flexible hose or pipe can be tethered (using a safety restraint) to another component of the hydraulic fracturing system. In the event of a rupture or other failure, the safety restraint retains the tethered flexible pipes or hoses in a fixed position to prevent injury to personnel or damage to surrounding equipment.

13 Claims, 5 Drawing Sheets

APPARATUS AND METHODS FOR INTERLOCKING HYDRAULIC FRACTURING EQUIPMENT

BACKGROUND

Hydraulic fracturing systems utilize fracturing fluid to collect gas and/or oil from geological formations deep below the earth's surface. One or more fracturing pumps are used to pressurize the fracturing fluid to a level which exceeds the tensile strength of the subterranean geological formations below the earth's surface. When distributed into a wellbore, the highly pressurized fluid generates micro fissures or cracks within the geological formations surrounding the wellbore. After the wellbore is depressurized, proppant material in the fracturing fluid remain in the fissures to hold the fissures open so that oil and/or gas trapped within the geological formations can be harvested through the wellbore.

SUMMARY

In an example of the present disclosure, a system and a method for interconnecting components of a hydraulic fracturing system is disclosed. The method can include positioning a plurality of pumps adjacent to a manifold. The pumps and the manifold can be configured to operate within the hydraulic fracturing system. Each of the plurality of pumps can have a respective pump connection. The manifold can have a plurality of manifold connections configured to be connected to each of the plurality of pumps. The method can also include coupling a first end of a first flexible hose to one of the respective pump connections. The method can further include coupling a second end of the first flexible hose to one of the plurality of manifold connections. The method can include coupling a first end of a second flexible hose to one of the respective pump connections. The method can also include coupling a second end of the second flexible hose to one of the plurality of manifold connections. The method can include positioning a portion of the first flexible hose of the plurality of flexible hoses adjacent to a portion of the second flexible hose of the plurality of flexible hoses. The method can further include wrapping at least one safety restraint around each respective portion of the first and second flexible hoses to tether the first flexible hose to a pump, to the manifold, or to a second flexible hose that is tethered to a pump, or to the manifold.

The hydraulic fracturing system can have a blender configured to receive and combine water, sand, and chemicals into a slurry. The plurality of pumps can receive the slurry. The plurality of pumps can be configured to pressurize the slurry and deliver the pressurized slurry to the manifold. In one example, the method can further include coupling a first end of a third flexible hose to one of the respective pump connections; coupling a second end of the third flexible hose to one of the plurality of manifold connections; positioning a portion of the third flexible hose of the plurality of flexible hoses adjacent to the portion of the first and second flexible hoses; and wrapping the at least one safety restraint around each respective portion of the first, second, and third flexible hoses to tether the third flexible hose to a pump, to the manifold, or to a second flexible hose that is tethered to a pump, or to the manifold.

In some examples, the plurality of flexible hoses can have an inner diameter of one to eight inches. The manifold can be a monoline system having multiple segment pods or a mobile trailer that can be either a monoline or multiple flow system trailer, as has been historically used in the industry. A portion of the safety restraint can be wrapped substantially perpendicular relative to a longitudinal axis defined by the first flexible hose or the second flexible hose. The plurality of pumps can be configured to be transportable to a fracturing site using one or more trucks.

Features from any of the disclosed embodiments can be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Figure 1:
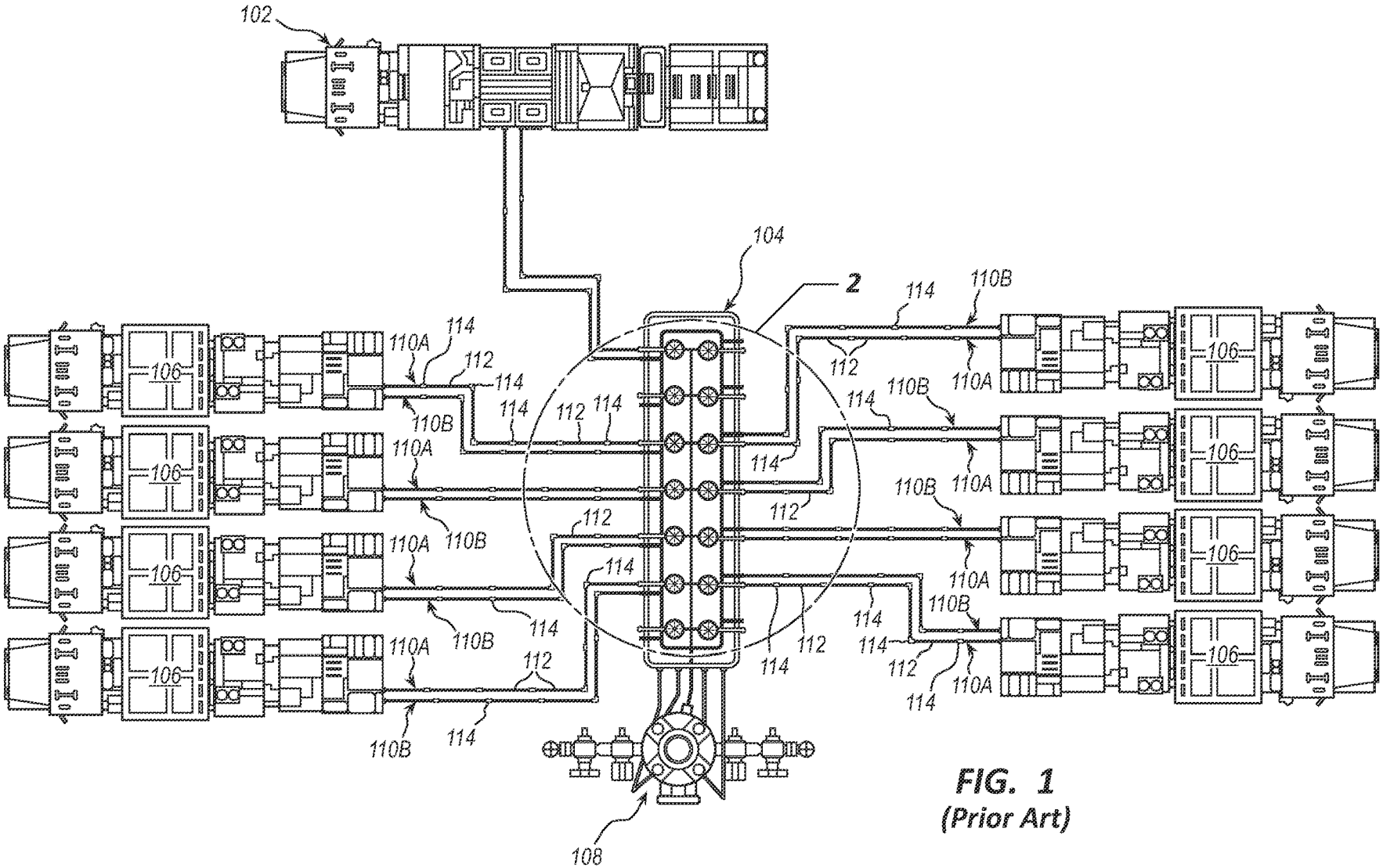
FIG. 1 (Prior Art)
FIG. 1 is a top view of a conventional hydraulic fracturing system.

Utilizing hydraulic fracturing techniques to accelerate oil and gas production from geological formations typically includes pumping highly pressurized fracturing fluid (i.e., a mixture of water, sand, and chemicals, which are blended into a slurry) into a wellbore. One or more pumps (e.g., pump trucks) are used in conjunction with a manifold to pressurize the fracturing fluid to a pressure commonly ranging from 5,000 PSI to 20,000 PSI, or more. The pressurized fracturing fluid is thereafter delivered to the wellhead and pumped into the wellbore. Rigid metal pipes capable of withstanding the highly pressurized fracturing fluid have been used to couple the multitude of mechanical systems of the fracturing site to one another. Rigid stalks of steel tubular pipe, referred commonly in the industry as iron, have been interconnected using connectors (e.g., chiksan swivel joints) to couple each pump to the manifold. The metal pipes and connectors can form a rigid flow line that interconnects the various components of the hydraulic fracturing system.

As used in this specification, the terms "manifold", "missile", "monoline", and "pods" can be used interchangeably. The singular forms "a," "an" and "the" include plural referents unless the context clearly dictates otherwise. Thus, for example, the term "a missile" can be intended to mean a single means to collect and distribute fluid or a combination of means to collect and distribute fluid. Additionally, or alternatively, "a manifold" can be intended to mean one or more manifolds, or a combination thereof.

Rigid metal pipes and connectors, however, introduce significant insufficiencies within the fracturing system. For example, because each fracturing site has a unique topographical landscape, the rigid metal pipes and connectors must be uniquely assembled to accommodate elevation variations and other unique features of the fracturing site. Consequently, each connector increases the cost of the project and also increases the time it takes to set up the fracturing site. Moreover, each additional connection in the flow line creates a potential location for failure (e.g., a leak). Although rated for high pressure use, the rigid metal pipes and the required connectors are susceptible to failure induced by shifting machinery, vibration, cavitation, cyclic fatigue, and pressure spikes. To inhibit movement of the metal pipes, the metal pipes can be affixed to the pump via a mounting system, but mounting the metal pipes to the pump also increases the cost and complexity of each pump truck along with increasing the setup time and cost of each fracturing site. Moreover, if the metal pipe needs to be moved to a new fluid outlet on the pump, the entire mounting system must be removed and replaced with a new mounting system that accommodates the new position of the fluid outlet.

The metal pipe and connectors can be dangerous when high pressure causes a metal pipe, connector, or both to catastrophically fail (e.g., a line rupture). Flow line safety restraints are therefore wrapped around each section of straight metal pipe and each connector to ensure the safety of personnel and equipment on the fracking site. For example, a first safety restraint is positioned to extend parallel to each length of metal pipe and each connectors. Thereafter, many safety restraints are wrapped around each straight section of metal pipe and the first safety restraint to effectively tether the entire length of the flow line together. A typical fracturing site often includes many pumps coupled to the manifold by respective flow lines. Each of these flow lines must be secured using safety restraints. Unfortunately, positioning flow lines constructed using rigid metal pipe and connectors within close proximity to adjacent flow lines is challenging given the dimensions of the pumps. A large quantity of safety restraints are fitted within the fracturing system due to the complexity of fitting iron within a compressed are to allow for the required points of freedom. Again, the large number of safety restraints increases the time it takes to set up the fracturing site and the overall cost of the fracturing site.

In one aspect of the present disclosure, a flexible pipe or hose (i.e., a flexible flow line) capable of withstanding pressure in excess 15,000 PSI is utilized to couple various components of a fracturing system. For example, a flexible pipe or hose can be used to connect a pump to the manifold. Interconnecting components of the fracturing system using a flexible pipe can significantly reduce the cost of the system by reducing the number of connectors and safety restraints utilized to safely and appropriately operate the system. Utilizing flexible pipe or hoses also decreases the likelihood of system failure by reducing the number of connections, thereby reducing the risk of a leak. Additionally, flexible pipe can be quickly and easily installed, which substantially reduces set-up time. Furthermore, flexible pipe can be routed within a smaller area, thereby reducing the overall footprint of the fracturing site. Flexible pipe or hose can absorb and even dampen system vibrations, reducing the likelihood of failure relating to shifting machinery, vibration, cavitation, cyclic fatigue, and pressure spikes. In short, utilizing flexible pipe or hose increases the durability of the flow line while reducing the cost of operating the fracturing site and the time it takes to set up/maintain the fracturing site.

Flexible hose can be used to interconnect multiple components of the fracturing site. For example, flexible hose can be used to connect one or more pumps to a manifold or missile. In fracturing systems that include a monoline system having two or more segment pods, each pod can be interconnected to another pod and/or a pump using flexible hose or pipe. Interconnecting segment pods of a monoline system with flexible hose can be advantageous to quickly and simply route the hose around obstacles or to interconnect pods positioned on uneven terrain. Flexible hose also permits the pods to be positioned or repositioned in a staggered orientation to reduce the overall footprint of the fracturing site or to work around obstacles on the fracturing site.

At a fracturing site that couples multiple pumps to a manifold (or segment pods of a monoline system) using flexible hoses, many of the hoses can be positioned adjacent to one another, thereby drastically reducing the number of safety restraints needed to tether the flexible hoses together, for instance if restrained in pairs. Moreover, flexible pipe or hose also requires fewer safety restraints because the flexible pipe is continuous along the length of the flow line. In contrast, the traditional method of using multiple straight segments of stalk iron pipe interconnected by swivels requires a restraint at each end of each straight segment to safely retain the flow line in case of rupture and to prevent the iron pipe from becoming a deadly projectile if a rupture occurs.

In some embodiments, a method for interconnecting components of a hydraulic fracturing system can include positioning a plurality of pumps near or adjacent to a manifold of a fracturing system. Each of the plurality of pumps includes a respective pump connection. The manifold includes a plurality of manifold connections. The method includes coupling a first end of a first flexible hose (i.e., flexible flow line) with one of the respective pump connections. The method also includes coupling a second end of the first flexible hose to one of the plurality of manifold connections. The method can also include coupling a first end of a second flexible hose with one of the respective pump connections. The method can further include coupling a second end of the second flexible hose to another one of the plurality of manifold connections. The method can also include positioning a portion of first flexible hose of the plurality of flexible hoses adjacent to a portion of the second flexible hose of the plurality of flexible hoses. For example, a mid-portion of the first flexible hose can be positioned next to a mid-portion of the second flexible hose.

As used in this specification, the term "pipe" and "hose" are used interchangeably. The singular forms "a," "an" and "the" include plural referents unless the context clearly dictates otherwise. Thus, for example, the term "a hose" is intended to mean a single hose or a combination of hoses. Similarly, "a pipe" is intended to mean one or more pipes, or a combination thereof.

FIG. 1 is a top view of a conventional hydraulic fracturing system 100. The hydraulic fracturing system 100 includes a blender 102, a manifold or missile 104, one or more pumps 106, and a wellhead 108. Each pump 106 is coupled to the missile 104 by a set of rigid metal flow lines 110, wherein one flow line is a low-pressure line and the other is a high-pressure line.

Figure 2:
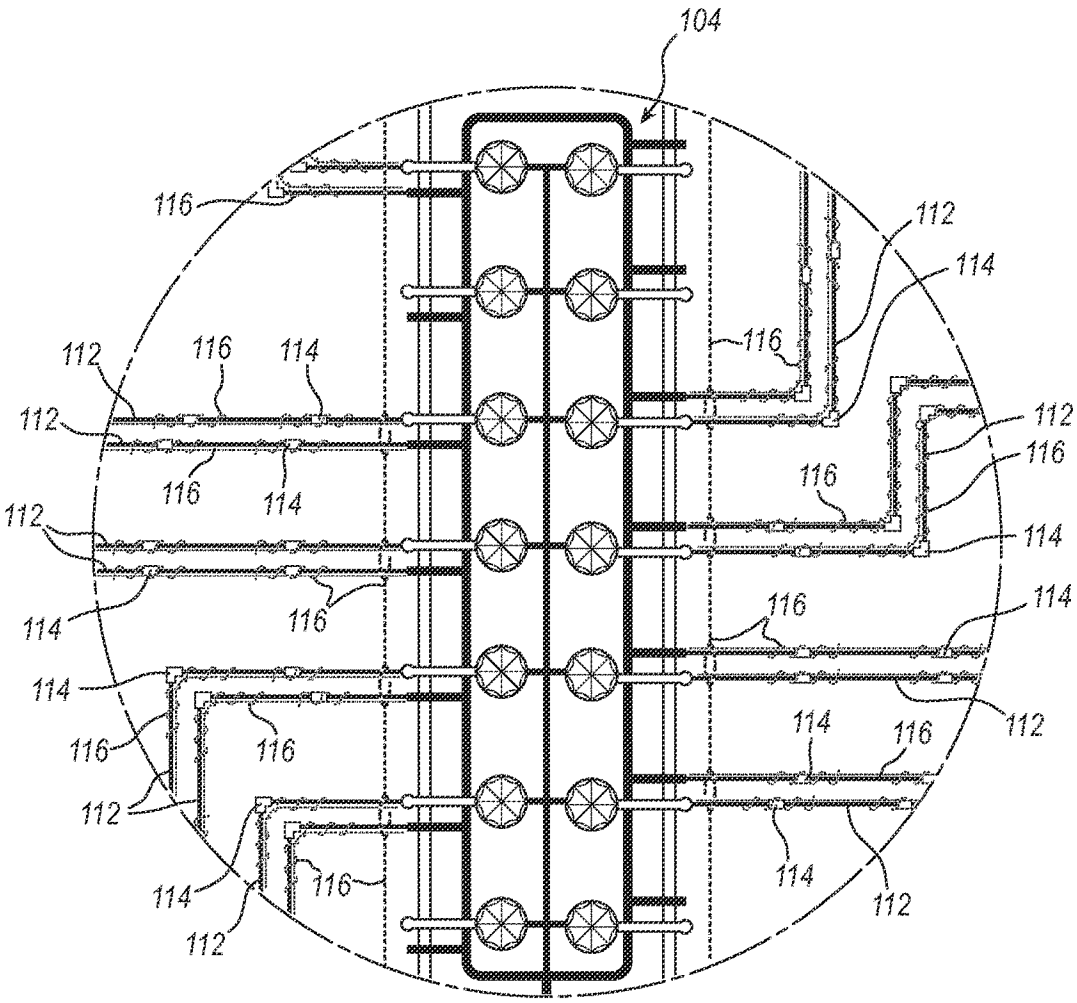
FIG. 2 (Prior Art)
FIG. 2 is a detailed view of the conventional hydraulic fracturing system shown in FIG. 1, depicting rigid metal pipes coupling the pumps to the manifold.

FIG. 2 is a detailed view of the conventional hydraulic fracturing system 100 shown in FIG. 1 depicting rigid metal high-pressure flow lines 110 coupling the pumps 106 to the manifold or missile 104. More specifically, each of the pumps 106 are connected to the missile 104 by a high pressure rigid metal flow line 110A, and a low pressure metal flow line 110B, that can be rigid or flexible. Each rigid metal flow line 110A, 110B includes multiple straight sections of metal pipe 112 and multiple metal connectors 114.

Because conventional hydraulic fracturing systems 100 utilize straight sections of metal pipe 112, connectors 114 are required to route the flow line 110 between the pump 106 and the missile 104. Each connector 114 introduces a potential site for a leak to propagate within the system 100. For example, a connector 114 can leak when pressure tests are conducted on the system 100.

Safety restraints 116 must be positioned around each end of each straight section of metal pipe 112 to sufficiently restrain the flow line 110 during failure. Even a single straight section of metal pipe 112 that is not wrapped by a safety restraint 116 can injure personnel and/or destroy other equipment during a catastrophic failure of that flow line 110.

Figure 3:
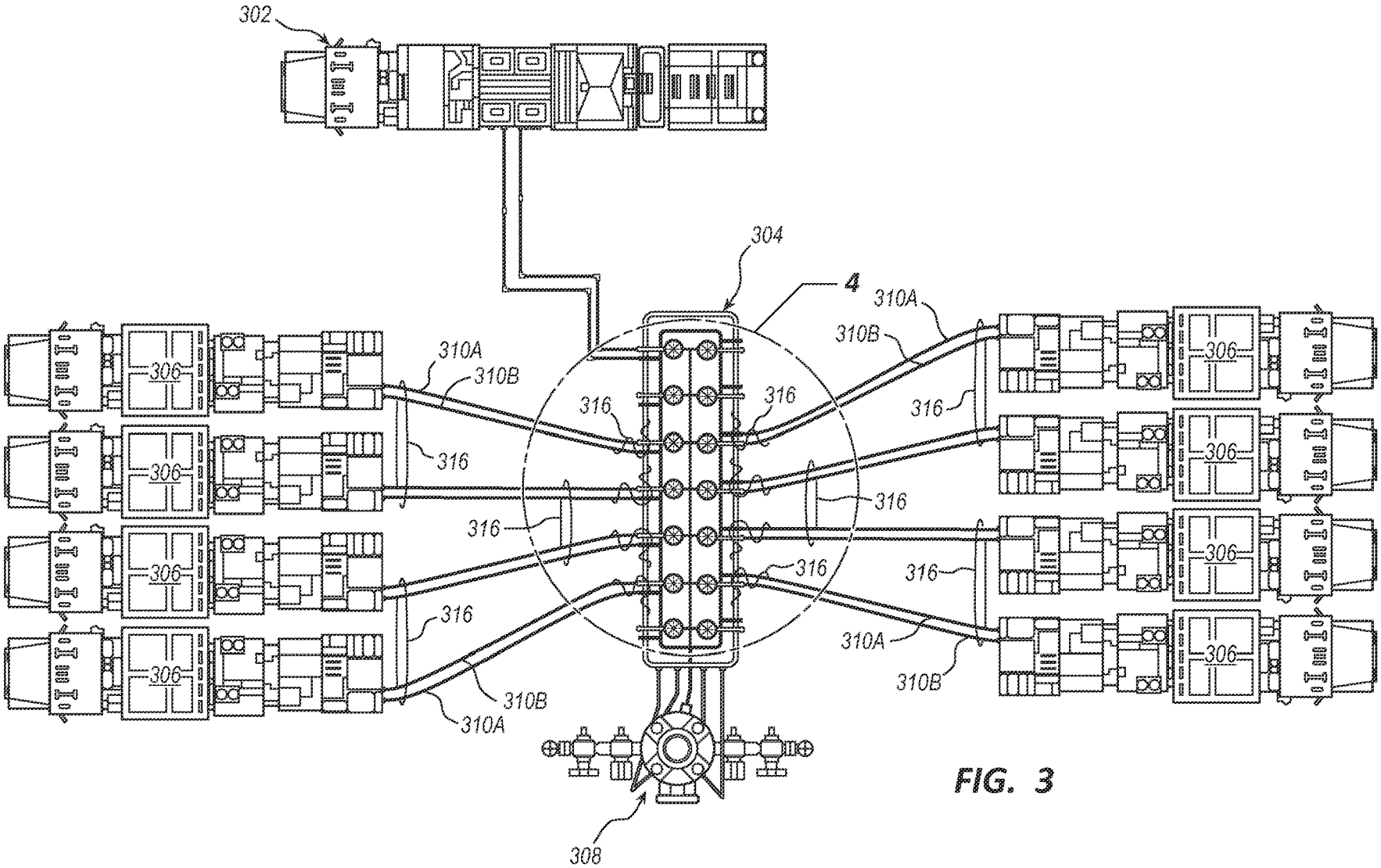
FIG. 3 is a top view of a hydraulic fracturing system, according to one example of the present disclosure.

FIG. 3 is a top view of a hydraulic fracturing system 300 according to the present disclosure. The hydraulic fracturing system 300 includes a blender 302, a manifold or a missile 304, one or more pumps 306, and a wellhead 308. The blender 302 is configured to receive components of a fracturing fluid (e.g., water, sand, chemicals, etc.) and blend the components into a slurry. The blender 302 delivers the blended fracturing fluid to the missile 304 at a low pressure. The missile 304 delivers the fracturing fluid to the pumps 306 at a relatively low pressure. The pumps 306 then pressurize the fracturing fluid to a pressure ranging between 5,000 PSI to 20,000 PSI, or more. The pumps 306 deliver the pressurized fracturing fluid to the missile 304. The missile 304 then delivers the pressurized fracturing fluid to the wellhead 308, which routes the fluid into steel casing in the wellbore (not shown).

Each pump 306 is coupled to the missile 304 by a set of flexible flow lines 310. For example, each pump 306 can have a set of connections configured to interlock, engage, or otherwise couple to a fitting affixed to each end of the flexible flow line 310. Similarly, the missile or manifold 304 can include a set of connections configured to interlock, engage, or otherwise couple to a fitting affixed to each end of the flexible flow line 310.

Each of the flexible flow lines 310 can transfer fluid (e.g., fracturing fluid) at rate between 3 and 30 barrels per minute (bpm). For example, each flexible flow line 310 can transfer at least 3 bpm, between about 3 bpm and about 7 bpm, between about 7 bpm and about 15 bpm, between about 15 bpm and about 20 bpm, or less than 30 bpm. Each of the flexible flow lines 310 can be rated to transfer fluid (e.g., fracturing fluid) at pressures between 5,000 psi and 20,000 psi. For example, each flexible flow line 310 can transfer fluid at a pressure of at least 300 psi, between about 300 psi and about 1,000 psi, between about 1,000 psi and about 5,000 psi, between about 5,000 psi and about 10,000 psi, between about 10,000 psi and about 15,000 psi, or less than 30,000 psi. Each of the flexible fluid flow lines 310 can have a diameter (e.g., diameter of the hose) of between 1 inch and 5 inches. For example, one or more of the flexible flow lines 310 can have a diameter of 3 inches. In some examples, one or more of the flexible flow lines 310 can have a diameter that is dissimilar from a diameter of another one of the flexible flow lines 310.

In some examples, at least one of the flexible flow lines 310 can be 3 inches in diameter and flow about 6 bpm of fluid under about 11,000 psi. Each of the flexible flow lines 310 can define a singular flexible fluid path between the respective pumps 306 and the missile 304. The singular fluid path defined by the flexible flow lines 310 eliminates the need for connectors between segmented piping which can leak when exposed to high pressure. Unlike rigid metal pipe, the flexible flow lines 310 can be easily routed between a pump 306 and the missile 304, regardless of surface elevation discrepancies between the pump 306 and the missile 304 or obstacles on the fracturing site (e.g., guy wires, mobile trailers, auxiliary equipment, wellhead blowout preventor controls, etc.) Thus, the use of the flexible flow lines 310 reduce the overall cost, footprint, and setup time of the hydraulic fracturing system 300.

The flexible flow lines 310 also facilitate adjustment and mobility of the various components of the hydraulic fracturing system 300 as needed. For example, the missile 304 may need to be repositioned to create space for an additional wellhead, manifold, or other piece of fracturing equipment. The flexible flow lines 310 can accommodate shifting the missile while the flow lines 310 remain attached, whereas adjustment of rigid metal flow lines requires significant time for disassembly, design, part collection, and reconfiguration to conform to the new position of the missile. Even if the components are disconnected for repositioning, the present flexible flow lines 310 are easily disconnected by the release of one connection at each end of the flexible flow line, ensuring that any repositioning or modification of the fracturing system 300 is less complicated and faster than performing the process with rigid fixed pipes.

Although the flexible flow lines 310 are depicted in FIG. 3 as interconnecting the pumps 306 and the missile 304, it should be appreciated that this disclosure contemplates utilizing flexible flow lines to interconnect all types of hydraulic fracturing equipment that are tied together under pressure including, but not limited to, pumps, manifolds, missiles, monolines, wellheads, pressure monitoring equipment, acoustic monitoring equipment, valves, or a combination thereof. For example, for hydraulic fracturing systems that utilize multiple monoline segment pods and manifolds, the flexible flow line (i.e., flexible hose or pipe) can be utilized to interconnect the individual segment pods.

In some examples, the flexible flow lines 310 can additionally or alternatively be coupled to legacy missiles, manifolds, pods, or any other equipment to replace rigid metal high-pressure flow lines (e.g., rigid metal high-pressure flow lines 110) being used to flow fluid to the wellhead 308. As used herein, the term "legacy" can refer to any pre-existing or previously arranged conventional hydraulic fracturing systems (e.g., conventional hydraulic fracturing system 100) currently utilizing rigid metal high-pressure flow lines (e.g., rigid metal high-pressure flow lines 110) to procure oil and/or gas from geological formations.

Figure 4:
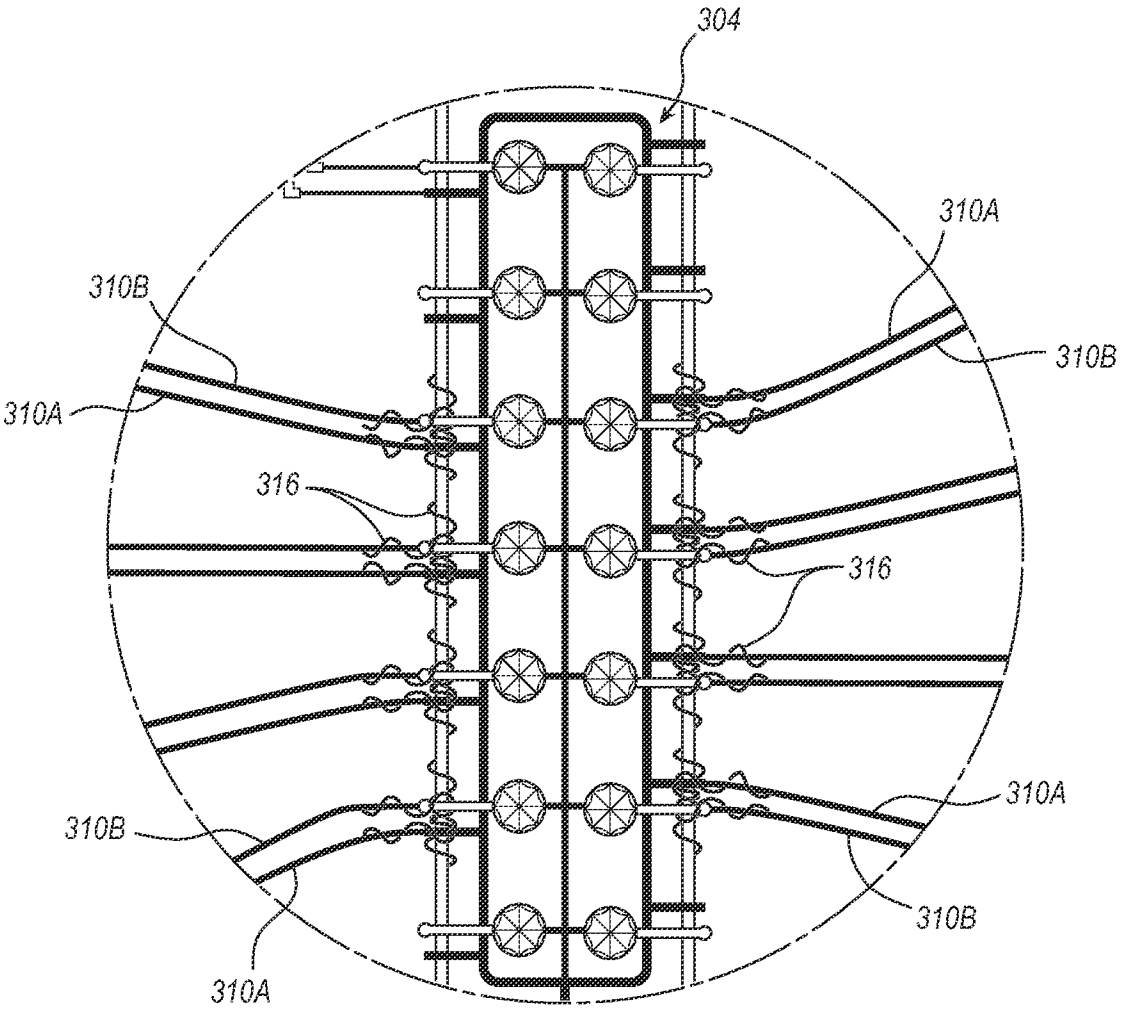
FIG. 4 is a detailed view of the hydraulic fracturing system shown in FIG. 3, depicting flexible flow lines coupling the pumps to the manifold.

FIG. 4 is a detailed view of the hydraulic fracturing system shown in FIG. 3 depicting flexible flow lines 310 coupling the pumps 306 to the missile 304. More specifically, each of the pumps 306 are interconnected to the missile 304 by a high pressure flexible flow line 310A and a low pressure flexible flow line 310B. Because the flow lines 310 are flexible, they can be quickly positioned and easily connected to the pumps 306 and the missile 306. If needed, the a portion of the high pressure flexible flow line 310A or the low pressure flexible flow line 310B can be positioned to facilitate anchoring, to avoid obstacles, or for space efficiency. Additionally, as illustrated in FIG. 4, each end of the high-pressure flexible flow lines 310A are coupled to the pumps 306 or the missile 304, respectively. This positioning and securing of the ends of the flexible flow lines 310 requires far fewer safety restraints 316 to adequately restrain the flexible flow lines 310 in the event of a failure (e.g., a rupture). For example, a single safety restraint 316 can be utilized on each end of each flexible flow line 310 to adequately retain the flexible flow lines 310 to the pumps 306 and to the missile 304. In some instances, some of the plurality of flexible flow lines 301 can be anchored together at the pump 306 or missile 304 end.

While the safety restraints 316 are depicted as tethering or coupling the flexible flow lines 310 to the missile 304, those having skill in the art will appreciate that the configuration of safety restraints 316 shown in FIG. 4 is one example configuration of many possible configurations. For example, in some configurations, a single safety restraint 316 can couple or tether multiple flexible flow lines 310. Additionally, or alternatively, one or more of the safety restraints 316 can be anchored to the ground and/or another object using an anchor point system.

While the current configuration is described as including a single high pressure flexible flow line connecting the pump and the missile, in one embodiment, a single hose can be connected to the missile at a first and can include a hose connection at a second end. This configuration allows for a high-pressure hose connected at the outlet of the pump. According to this exemplary embodiment, a pump can be connected to the manifold through two high-pressure hoses. When the pump is to be disconnected to remove it from pumping (say for maintenance), the two high-pressure hoses can be decoupled and another pump with its own dedicated high-pressure hose can then be rigged in to connect with the first high-pressure hose, without removing the connection with the missile.

Figure 5:
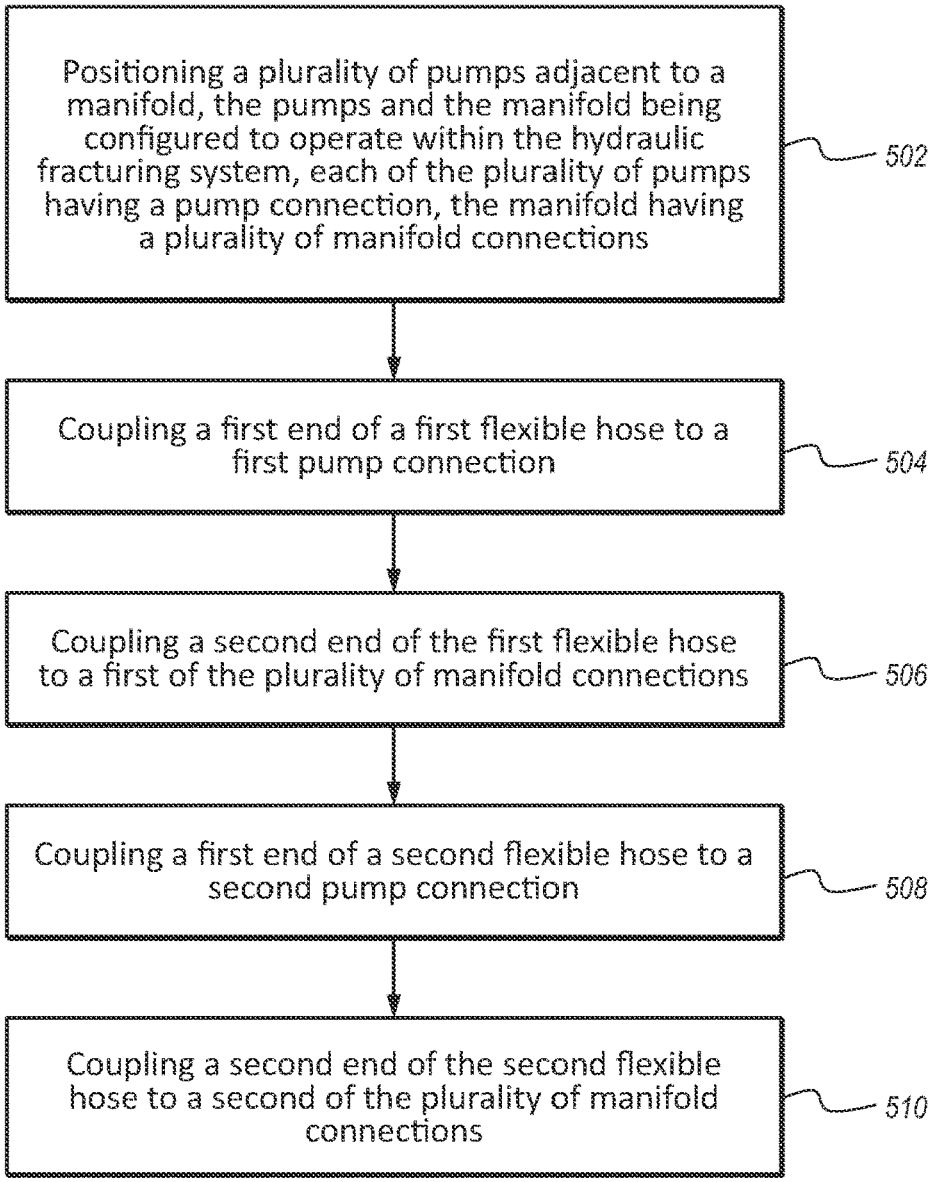
FIG. 5 is flow diagram of a method for interconnecting components of a hydraulic fracturing system.

FIG. 5 is a flow diagram of a method for interconnecting components of a hydraulic fracturing system. The method 500 can include at least some of acts 502, 504, 506, 508, or 510. The method 500 is for illustrative purposes and, as such, at least one of the acts 502, 504, 506, 508, or 510 can be performed in a different order, split into multiple acts, modified, supplemented, combined, or omitted.

The method 500 optionally includes, at act 502, positioning a plurality of pumps adjacent to a manifold. The pumps and manifold can be configured to operate within a hydraulic fracturing system and each of the plurality of pumps can include a respective pump connection. Similarly, the manifold can include a plurality of manifold connections which coincide with the pump connections. Method 500 optionally further includes, at act 504, coupling a first end of a first flexible hose to one of the respective pump connections. The flexible hose can be connected to the pump connections by any number of connection methods currently known or developed in the future, including a Grayloc® connector, a C-hub connector, a flange connector, and/or wings on a threaded connection, such as a hammer union. Additionally, according to one embodiment, the connection system can include any number of quick connect systems, such as novel locking connections, to further enhance the connections of the high-pressure hoses. The use of quick connect systems would further speed rig-up times while exponentially expanding overall reliability of the entire high-pressure system. Alternatively, various and different connection systems may be used to connect the flexible hose to a pump, while a different connection system can be used to hydraulically connect the flexible hose to a manifold or monoline. According to one embodiment, the connection used at the manifold or monoline can have an integral larger end at the manifold where, according to one embodiment, one or more clamps secured to the manifold or monoline can be actuated to engage a corresponding feature defined in the end of the hose, such as a flat surface. The engagement can then be maintained, according to one embodiment, by mechanical or hydraulic pressure. Such a connection is often defined as a hydraulic/dry-break connection. In one example, preset stations can be formed to receive each pump truck and to establish a consistent connection to the missile, to eliminate any need to handle the flexible hose.

Method 500 further includes, at act 506, coupling a second end of the first flexible hose to one of the plurality of manifold connections. The flexible hose can be connected to the manifold connections by any number of connection methods currently known or developed in the future, including threading wings onto a threaded connection, or using the hydraulic connection system detailed above.

The method 500 also includes, at act 508, coupling a first end of a second flexible hose to one of the respective pump connections. The method 500 optionally includes, at act 510, coupling a second end of the second flexible hose to one of the plurality of manifold connections.

The method 500 optionally includes coupling a first end of a third flexible hose to one of the respective pump connections; coupling a second end of the third flexible hose to one of the plurality of manifold connections; positioning a portion of the third flexible hose adjacent to the portions of the first and second flexible hoses; and wrapping at least one safety restraint around each respective portion of the first, second, and third flexible hoses to tether the third flexible hose to the first, to the second, or to both the first and second flexible hoses.

While various embodiments of the hydraulic fracturing system, methods and devices have been described above, it should be understood that they have been presented by way of example only, and not limitation. Where methods and steps described above indicate certain events occurring in certain order, those of ordinary skill in the art having the benefit of this disclosure would recognize that the ordering of certain steps may be modified and such modifications are in accordance with the variations of the invention. Additionally, certain of the steps may be performed concurrently in a parallel process when possible, as well as performed sequentially as described above. The embodiments have been particularly shown and described, but it will be understood that various changes in form and details may be made.

For example, although various embodiments have been described as having particular features and/or combinations of components, other embodiments are possible having any combination or sub-combination of any features and/or components from any of the embodiments described herein. In addition, the specific configurations of the various components can also be varied. For example, the size and specific shape of the various components can be different than the embodiments shown, while still providing the functions as described herein.

The invention claimed is:

1. A method for interconnecting components of a hydraulic fracturing system, the method comprising:

positioning a plurality of pumps adjacent to a manifold, the pumps and the manifold being configured to operate within the hydraulic fracturing system, each of the plurality of pumps having a pump connection, the manifold having a plurality of manifold connections;

coupling a first end of a first flexible hose to a first pump connection;

coupling a second end of the first flexible hose to a first of the plurality of manifold connections;

coupling a first end of a second flexible hose to a second pump connection; and coupling a second end of the second flexible hose to a second of the plurality of manifold connections; and wrapping at least one safety restraint around each of the first and second flexible hoses to tether the flexible hoses to each other.

2. The method of claim 1, further comprising:

tethering the first end of the first flexible hose to the first pump; and tethering the second end of the first flexible hose to the manifold.

3. The method of claim 1, wherein:

the hydraulic fracturing system further comprises a blender configured to receive and combine water, sand, and chemicals into a slurry;

the plurality of pumps receive the slurry; and the plurality of pumps are configured to pressurize the slurry and deliver the pressurized slurry to the manifold.

4. The method of claim 1 further comprising:

coupling a first end of a third flexible hose to a third pump connection;

coupling a second end of the third flexible hose to one of the plurality of manifold connections;

positioning a portion of the third flexible hose adjacent to the first flexible hose and the second flexible hose; and wrapping at least one safety restraint around each of the first, second, and third flexible hoses to tether the third flexible hose to the first, or to the second, or to both the first and second flexible hoses.

5. The method of claim 1, wherein the first pump connection and the plurality of manifold connections comprise at least one of wings and threads.

6. The method of claim 1, wherein the plurality of manifold connections are each hydraulically actuated connections.

7. The method of claim 1, wherein each of the plurality of flexible hoses have an inner diameter of from one inch to eight inches.

8. The method of claim 1, wherein the manifold comprises a monoline system having multiple segment pods including a high-pressure flexible hose connecting each of the segment pods into a system.

9. The method of claim 1, wherein a portion of the safety restraint is wrapped substantially perpendicular relative to a longitudinal axis defined by the first or second flexible hose.

10. The method of claim 1, wherein the plurality of pumps are configured to be transportable to a fracturing site using one or more trucks.

11. The system of claim 10, wherein the manifold is configured to output the pressurized fracturing fluid to one or more wellheads sequentially.

12. A hydraulic fracturing system comprising:

a pump having an outlet configured to output pressurized fracturing fluid;

a manifold having an inlet configured to receive pressurized fracturing fluid;

a flexible hose having a first end and a second end, the first end being configured to couple to the outlet, the second end being configured to couple to the inlet; wherein the flexible hose defines a flexible fluid path between the outlet of the pump and the inlet of the manifold, wherein the manifold comprises a plurality of inlets, each inlet of the plurality of inlets being configured to receive pressurized fracturing fluid from additional pumps having outlets, wherein the additional outlets and plurality of inlets are interconnected by additional flexible hoses; and a safety restraint configured to be wrapped around the flexible hoses to tether the flexible hoses to each other.

13. The system of claim 12, the safety restraint being wrapped substantially perpendicular relative to a longitudinal axis defined by the flexible hose.

* * * * *